US008808100B2

(12) United States Patent
Publicover et al.

(10) Patent No.: US 8,808,100 B2
(45) Date of Patent: Aug. 19, 2014

(54) SWING PLAY SYSTEMS AND METHODS OF PLAY

(71) Applicants: Mark W Publicover, Saratoga, CA (US); Jacob M Publicover, Saratoga, CA (US); Rachel C Publicover, Saratoga, CA (US)

(72) Inventors: Mark W Publicover, Saratoga, CA (US); Jacob M Publicover, Saratoga, CA (US); Rachel C Publicover, Saratoga, CA (US)

( * ) Notice: Subject to any disclaimer, the term of this patent is extended or adjusted under 35 U.S.C. 154(b) by 0 days.

(21) Appl. No.: 13/647,598

(22) Filed: Oct. 9, 2012

(65) Prior Publication Data

US 2013/0045813 A1 Feb. 21, 2013

Related U.S. Application Data

(63) Continuation of application No. 10/919,623, filed on Aug. 17, 2004, now Pat. No. 8,282,498.

(60) Provisional application No. 60/498,216, filed on Aug. 26, 2003.

(51) Int. Cl.
*A63G 9/00* (2006.01)
*A63G 31/00* (2006.01)

(52) U.S. Cl.
USPC ..... 472/118; 472/128; 273/348

(58) Field of Classification Search
USPC ..... 472/118–125, 117, 128; 446/153; 273/352, 384, 441, 448, 460
See application file for complete search history.

(56) References Cited

U.S. PATENT DOCUMENTS 3,539,181 A 11/1970 Larsen
4,084,812 A 4/1978 Melrose et al.
4,177,991 A * 12/1979 Meyer et al. ..... 273/317
4,382,595 A 5/1983 Tolar
4,767,117 A 8/1988 Maio
5,016,891 A * 5/1991 Nelson ..... 273/407
5,382,026 A 1/1995 Harvard et al.
5,482,292 A 1/1996 Stone
5,839,964 A 11/1998 Rudell et al.
5,839,965 A 11/1998 Mullins
5,848,793 A 12/1998 Celis et al.
5,967,901 A 10/1999 Briggs et al.
6,060,847 A 5/2000 Hettema et al.

(Continued)

FOREIGN PATENT DOCUMENTS

WO 02/058810 A1 8/2002

*Primary Examiner* — Kien Nguyen
(74) *Attorney, Agent, or Firm* — Edward S. Sherman

(57) ABSTRACT

A play swing system includes a safety harness attached to each seat, as well as other features for interactive and competitive throwing and tossing games. The safety harness may incorporates various games features, and thus encourage use in activities that require at least one free hand, or otherwise increase the risk of slippage and falling from the play swing seat. Various embodiments accommodate as well as challenge the spatial perception, dexterity and reflexes of players of different ages. For examples, younger players might compete by throwing objects at a fixed target mounted on the ground. In other embodiments, the target is moving in synchronization with the oscillatory motion of the adjacent players swing by a physical coupling or attachment. Interactive play is encouraged at the higher skill levels by configuring the targets associated with adjacent seats to face each other. In this embodiment, the players oscillate in opposite directions so that they are closest to the target when the relative velocity is highest. The objects of the associated games can be building a higher score, as well as soaking the other player(s) with water supplied by an external source and actuated by instantaneous or accumulated contact of a throwing object with a target.

11 Claims, 8 Drawing Sheets

(56) References Cited

U.S. PATENT DOCUMENTS 6,155,936 A * 12/2000 Dorr ..... 473/456
6,283,870 B1 9/2001 Saint et al.
6,296,252 B1 10/2001 Hubka
6,464,594 B1 10/2002 Canna et al.
6,482,096 B1 11/2002 Rieber
6,773,016 B2 * 8/2004 Ochi ..... 273/448
6,908,397 B2 6/2005 Armbruster et al.
7,334,798 B2 * 2/2008 Halliburton ..... 273/447

* cited by examiner

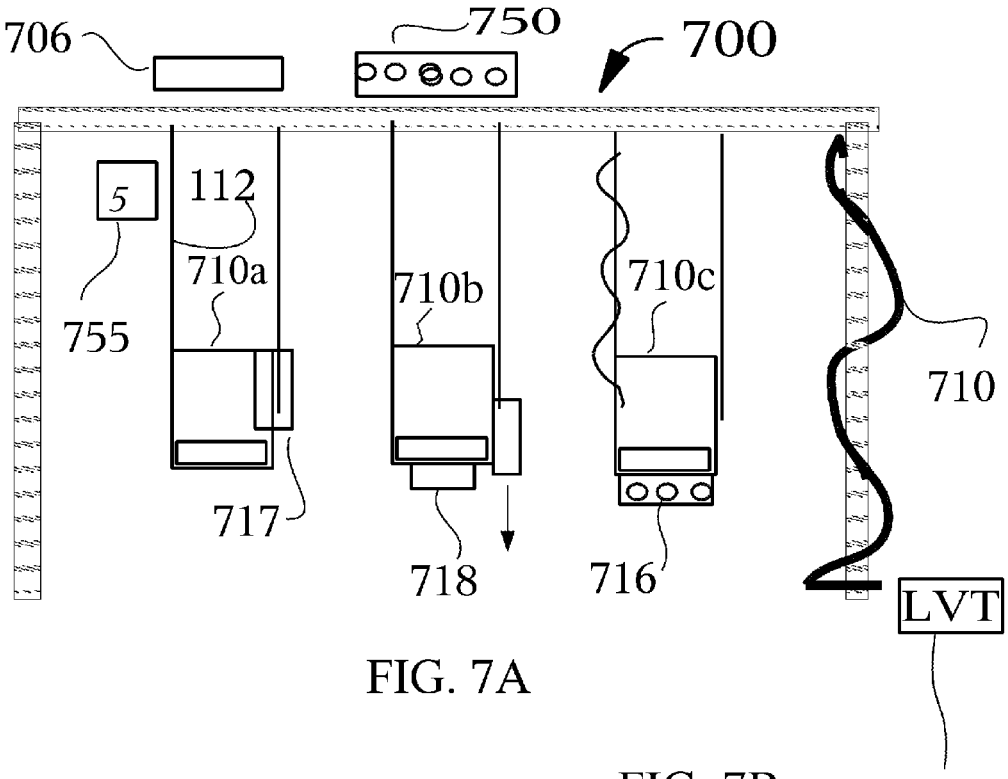
FIG. 7A
FIG. 7C
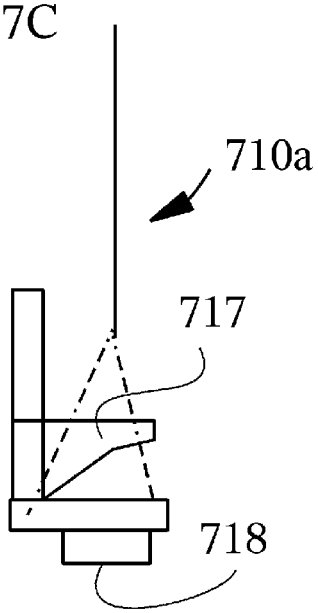
FIG. 7B
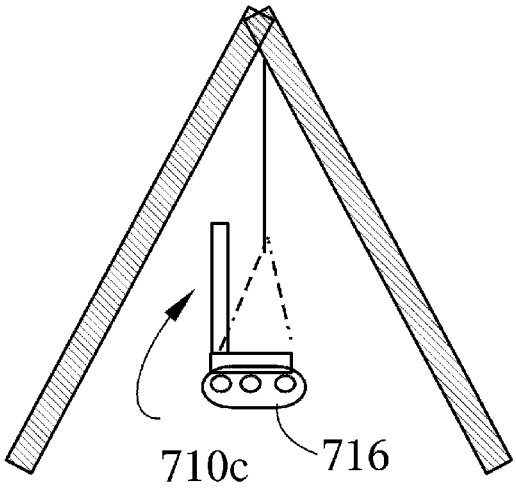

SWING PLAY SYSTEMS AND METHODS OF PLAY

CROSS REFERENCE TO RELATED APPLICATIONS

The present application is a Continuation of and claims the benefit of priority to the U.S. Non-provisional application having Ser. No. 10/919,623, titled "Play Swing Systems and Methods of Play", filed on Aug. 17, 2004. The present application also claims the benefit of priority to the U.S. provisional application having Ser. No. 60/498,216, titled "Play Swing Systems and Methods of Play", filed on Aug. 26, 2003, both of which are incorporated herein by reference.

BACKGROUND OF INVENTION

The present invention relates to play swings, including play and safety accessories for use therewith.

Although swings are a favorite play pastime of young children, they are rather quickly out grown, in the sense that older children lose interest. It is therefore a first object of the present invention to provide additional play activities for play swings. Yet another objective is to provide interactive and competitive play activity. In particular, a further objective is to provide for the safe conduct of activities that develop the coordination of spatial perception, dexterity and reflexes

SUMMARY OF INVENTION

In the present invention, the first object is achieved by providing a swing seat, for suspension and oscillatory motion from a horizontal support, various accessible toys, games or amusements that are coupled or otherwise associated with the seat or supporting structure in a cooperative arrangement. Such games and amusements may includes a variety of interactive targets that are independent of the play structure, or attached to a fixed or oscillatory component of the play structure, such as a container, bin or basket for receiving an object thrown by a player in the swing seat.

Further embodiments of the swing seat may include a harness for restraining the forward motion of a player out of the seat, depending on the nature of the play or game activity.

A second aspect of the invention is characterized in that the seat, swing system or both in combination includes a variety of water related play attachments that enable games or simply provide relief from hot and humid weather.

In yet another aspect of the invention the play system and methods include the use of game targets and projectiles while swinging. Manipulation of same can be used to control a water source, via an actuator responsive to movement of the target on impact with a projectile, or the accumulated weight of objects received in the target receptacle.

In yet further embodiments the optional safety harness incorporates features that encourage use when wet conditions or aggressive play increase the tendency for slippage and falling from a play swing seat. Various embodiments accommodate as well as challenge the spatial perception, dexterity and reflexes of players of different ages. For examples, younger players might compete by directly spraying opponents swinging in the same or opposite direction. In other embodiments, players must aim either water or other objects at the target to score points, or can simply soak the opposing player(s) with water. The target can be positioned on the ground, hung, associated with the movement of an adjacent players swing or with any moving object on the ground of otherwise, encouraging a higher skill level of interactive play, such as where players in adjacent seats oscillate in opposite directions.

In yet another aspect, the play swing system may alternatively includes a variety of visual or auditory output devices responsive to swing seat movement, target impacts, and the like, for example to indicate the range of swing motion so that bystanders can avoid collisions. Another example includes lights connected to the swing seat and/or supporting structures for games and for improved safety during use at night.

Yet other embodiments of the invention include a soap bubble generators associated with the swing seats movement to provide a slowly dissipating curtain of bubbles that enhance safety by indicating the extent of the swing arc to external observers, while also delighting children.

Alternative embodiments include audio output devices that are optionally responsive to the speed of movement for games and to improve safety during play. This also adds to the interactive play dimension for children as well as alerting adults and others that the swings are in use.

In yet another embodiment of the present invention, various game object and apparatus holders and controls for water, lights, guns, and sound are mounted on the side, front, back, top and bottom of the swing seat, on the swing arms, and on different areas of the play/support structure to enhance various interactive game activities. Preferably, these controls can be moved to various places on the swing set to customize and enhance games. The use of wired and wireless devices to ease installation and game customization and to allow for data transmission to a computer for game and activity feedback and interactivity. In more preferred embodiments of the invention, the safety harness includes an interlock mechanism such that its proper use is required to activate certain games or play activities.

The above and other objects, effects, features, and advantages of the present invention will become more apparent from the following description of the embodiments thereof taken in conjunction with the accompanying drawings.

BRIEF DESCRIPTION OF DRAWINGS

FIG. 7A is a front elevation view of a swing system, whereas FIG. 7B is a side elevation view showing one of the seat and the support structure thereof, whereas FIG. 7C is an expanded side elevation view of a different seat.

DETAILED DESCRIPTION

Figure 1:
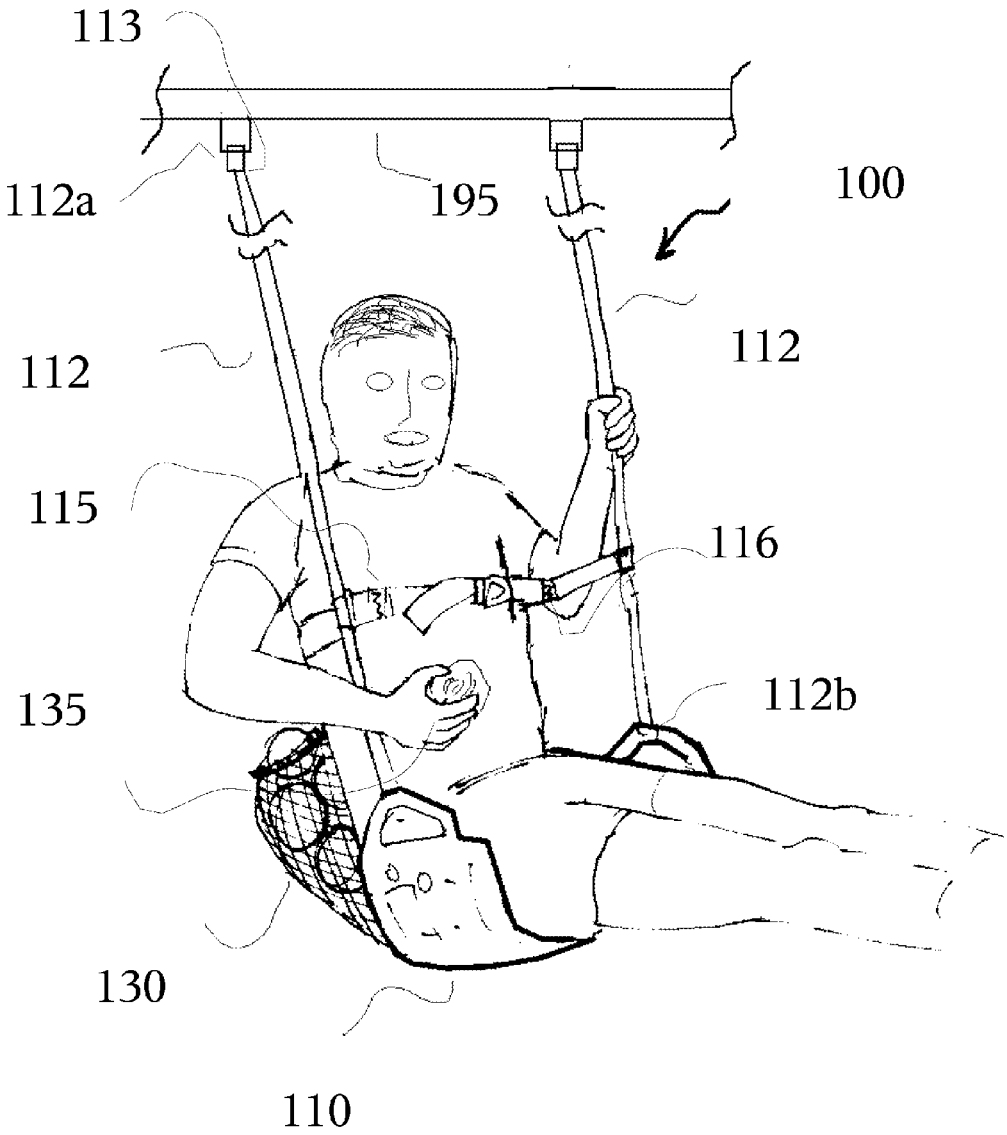
FIG. 1 is a perspective view illustrating a player using a swing embodying features of the present invention.

In accordance with one embodiment of the present invention, FIG. 1 is a perspective view illustrating a play system 100 wherein the player sits on a swing seat 110, which is suspended from a horizontal frame or member 195 by support cables 112. The upper end 112*a* of support cable 112 connects to horizontal member 195 by a coupling 113 that permits reciprocating movement about an axis parallel to horizontal member 112 such that swing seat connected at lower ends 112*b* of support cable 112 undergoes oscillatory motion below horizontal member 195. Seat 110 can be flexible or rigid, so long as it is sufficiently sturdy to support the player. Further, the seat 110 may have a back-supporting portion similar to a conventional chair, although it is not illustrated in this FIG. As the swing seat and system is intended to permit a variety of play activities that require a free hand, for example in this FIG., the player is holding a ball 135 in his right hand; the seat preferably further comprises a safety harness 115 for restraining the forward motion of a player out of the seat. Safety harness 115 can be attached to either the suspending cable 112, or seat 110, or an optional seat back. Harness 115 may comprise, as illustrated, one or more flat straps that meet at or near the player's chest and connect with a snapping buckle 116. As will be further discussed, other aspects of the invention provide for a range of additional components used in interactive play that generally require a free hand to operate or otherwise engage in.

When seat 110 is intended for use with target games, as will be further described below, the seat may also include a container 130 for storing balls, related throwing objects as well as related play equipment. Container 130 is optionally attached to the seat 110 directly, a seat back (not shown in this FIG.) or any portion thereof, so long as it is readily accessible to the seated player. Preferably it is designed so that it does not adversely affect swing balance, momentum or pose a safety hazard to another player or spectator. Alternatively, harness 115 may be connected to the seat through container 130. Although container 130 is illustrated as a mesh type storage sack, it might also comprise a rigid or semi-rigid container and that could be fabricated or molded into a rigid seat 110, particularly a rigid seat having a seat back. The mesh type presently preferred is fabricated from an elastic material to conform around the contents, thus preventing play objects from moving, shifting or escaping unintentionally during use. It should be understood that the proposed throwing objects and accessories includes soft balls, waffled or semi-rigid balls formed having a semi-perforated shell, foam balls, bean bags, "FRISBEE"-like objects, cushion tipped throwing projectiles, and the like.

Figure 2:
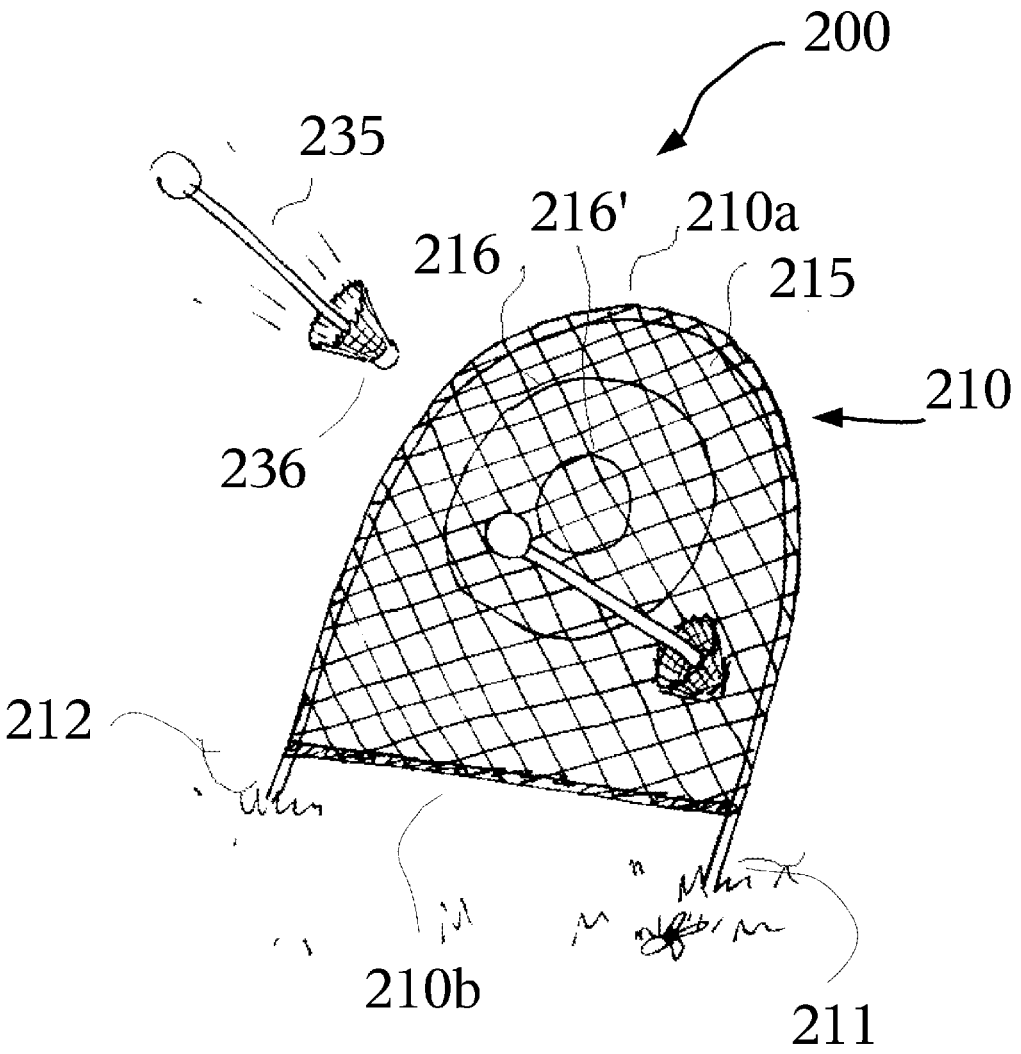
FIG. 2 is a perspective view illustrating a version of a ground mounted target that may optionally be used in conjunction with the swing system illustrated in FIG. 1

In accordance with another aspect of the invention, FIG. 2 is a perspective view illustrating a version of a ground-mounted target that may optionally be used in conjunction with the swing system illustrated in FIG. 1. As will be further described targets can be mounted from the swing itself, including swing seats, laid horizontal or flat on the ground, as well as in a partly upright position, being spaced away from the swing play area, as shown in FIG. 2. Target 200 has a peripheral frame 210 comprising an arching segment 210*a* and a horizontal segment 210*b*. Horizontal segment 210*b* connects at right angles near opposite ends of arched segment 210*a*, with the remaining segments of the arch portion 210*b* extending as supporting legs 211 and 212. Thus, the peripheral frame 210 is readily fabricated by flexing semi-rigid tubing to form the arch segment 210*a*, wherein the horizontal segment 210*b* is preferably constructed of tubing that is more rigid; for restraining the flexed tubing to maintain the arch shape. The face of target 200 is fabricated from fabric, "VELCRO" type hook and loop fasteners, or fence type mesh 215 that is laid or stretched over frame 210. The mesh 215 is marked with one or more zones 216 and 216', preferably concentric circles to represent increasing different point values for competitive play. Throwing object 235 is a projectile having an aerodynamic cone shaped tip 236 at the front end. The base of the cone is slightly larger than the mesh opening such that throwing object 237 has been retained by the mesh upon contact. The retaining features of the projectile and cone facilitate the tallying of the score as the players remove the projectiles at the end of the game. Alternatively, when the throwing objects are balls, beam bags or other have otherwise regular aerodynamic shapes, the target area may simply be one or more container such that the opening is the target area. Target 200 has the advantage that it is lightweight and can be mounted at various distances from the swings by pushing legs 211 and 212 into soft ground. Further, the difficulty of hitting the central target area 116' can be increased by decreasing the angle that legs 111 and 112 make with the ground. Decreasing the angle of the target encourages further physical activity, that is players will recognize that "pumping" the swing to a higher elevation increases the projected target area making it easier to aim at and hit central target area 116'.

As will be illustrated in various other embodiments, alternative forms of targets are mounted in association with each swing seat for receiving an object thrown by a player in an adjacent seat swinging in the opposite direction. While target 200 is generally intended to receive and retain an object 235 thrown by a player in the swing, any of the targets described herein can also be a photoreceptor target for electronic laser tag type play (where a player uses a very low power laser gun) or otherwise controls a light or projectile source from the swing or swing movement. When the targets include laser tag sensors, which are preferably mounted on a moving part of the swing seat, such as the players the safety harness.

Figure 3:
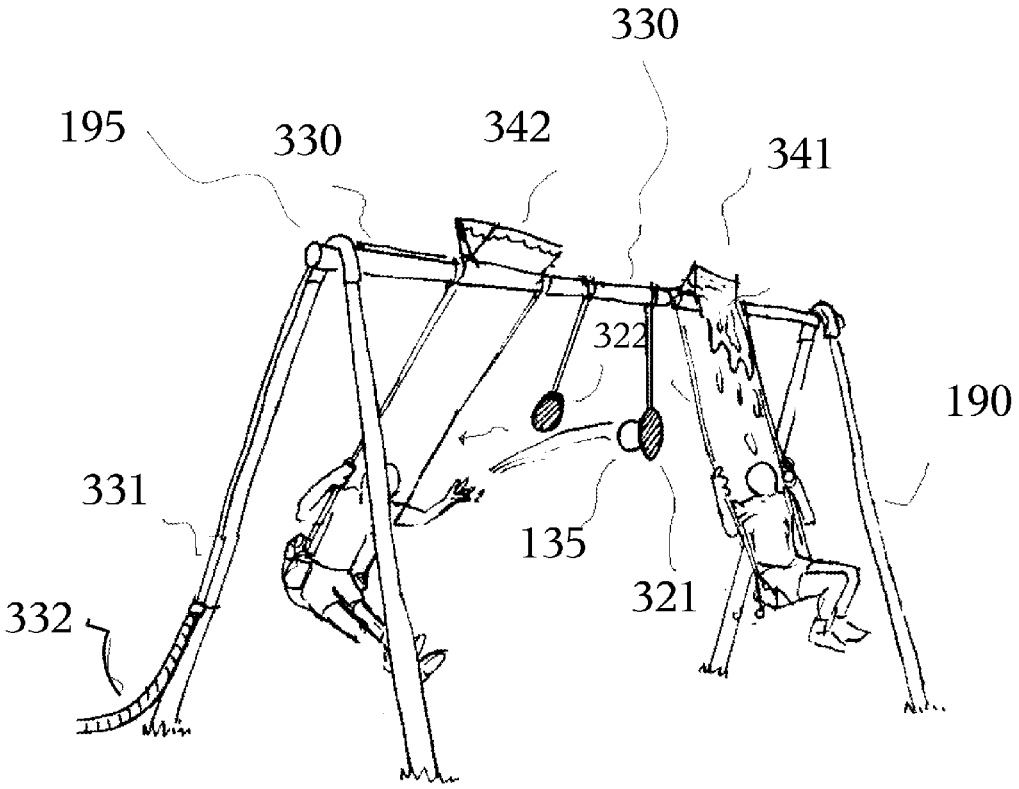
FIG. 3 is a perspective view illustrating another version of a swing and system in which two players participate in interactive water games using alternative features of the present invention.

FIG. 3 is a perspective view illustrating two players in an interactive water game on another version of a swing system embodying different features of the present invention. Each of seats 311 and 312 has a water trough 341 and 442 mounted on the horizontal member 195 above the player. Water troughs 341 and 342 are filled via water source 330 that runs along horizontal support 195. Water source 330 is generally a conduit that extends downward toward ground level along vertical support leg 190 where it is coupled to an ordinary garden hose 332 at port 331. A floating valve or other fill level response switch is preferably disposed at or in the water troughs such that trough can be filled to near capacity after emptying. The object of the game is to throw an object, or otherwise activate the target, at the opposing player's target, such as 321, and drench the player in seat 311 with water from the self-filling water trough 341 as shown. The water trough is optionally mounted on a flexible hinge, joint or gimbals such that it will normally be upright but is tipped over or otherwise releases water out of the bottom in response to the movement or other actuation of the associated target. The target 341 can be directly coupled to the trough so the water is dumped by either disturbing the balance of the trough or by releasing a latch or shutter, which normally prevents the trough from tipping under its own weight. It will be recognized by one of ordinary skill in the art that there are many alternative types and locations for water-releasing sources, for example, the trough can be placed between the suspending cables 112, and thus moved closer to the player. Alternatively, hitting the target can activate a self-closing aperture at the bottom of the trough so that the water is released as a slow downward shower to wet the player when they swing directly under the horizontal support 195. In yet another embodiment the target can have multiple zones that cause either a fast or slow emptying of the trough. Alternatively, the water trough can be mounted on gimbals associated with the seat suspension members 112 that extend downward from the horizontal frame 195.

It will be further recognized by one of ordinary skill in the art that the use of a trough or other water storage vessel above the players is not essential, as it can be replaced by spray or misting nozzles, that are either continuously on or open in response to hitting a target, movement of the swings, or manually operated as dictated by game rules and activities.

In a further alternative embodiment the targets motion upon projectile impact is coupled to actuate the valve that fills the trough with water. Thus, the trough mounting can be otherwise independent of the target, for example by a flexible hose, such that the trough dumps water or overflows in response to an imbalanced weight distribution upon filling. In all these embodiments, it is preferable that the timing of the release of the water can be controlled to maximize the fun.

Yet another alternative embodiment is to provide a container for capturing water from spray nozzles or other water outlets associated with water source, which for example can be responsive to accumulated contact of throwing objects with the target. Alternatively, the spray nozzles are optionally connected to water trough such that player can only spray water when trough is at least partly full.

Alternatively the flat target shown in FIG. 3 can be replaced with an open container for receiving throwing objects or water whereby the accumulated weight of throwing objects captured by the target receptacle provides a force that releases any of the previously described actuation mechanisms to release, dump, shower, spray or mist water onto at least one of the players. The target need not be suspended from horizontal member 195, but can also be attached to the adjacent swing seat, as is further described with respect to FIG. 4.

Figure 4:
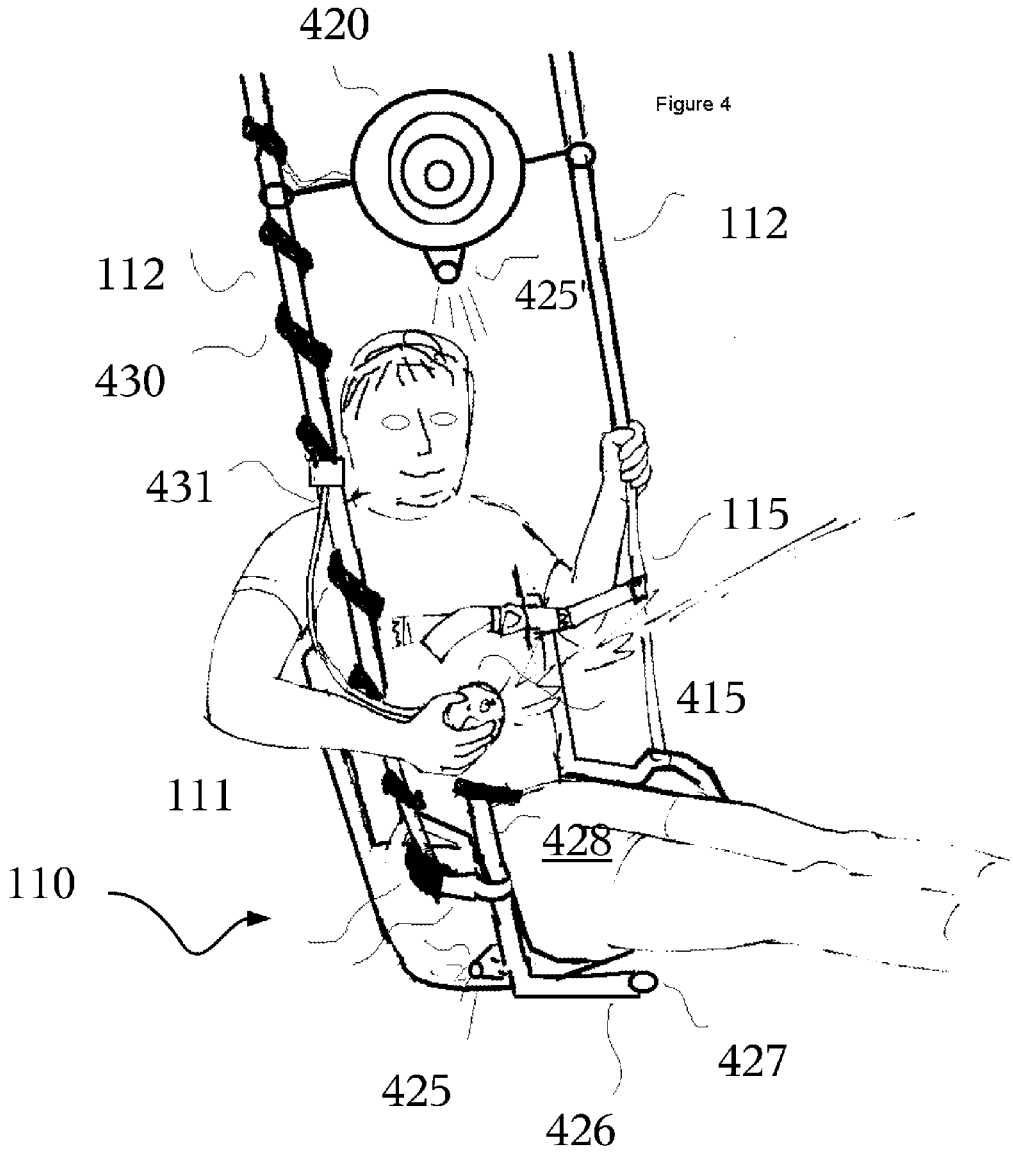
FIG. 4 is a perspective view illustrating a player using a swing embodying alternative water play features of the present invention.

FIG. 4 is a perspective view illustrating a player in another version of the swing embodying alternative water play features of the present invention. As in FIG. 4, swing seat 110 is designed for suspension from a horizontal frame 195 (not shown) via cables 112 for oscillatory motion. Water from source 340 (not shown) flows down toward the seat 110 via a pipeline 430 wrapped around suspending cables 112. A water pistol 415, held in the right hand of the seated player is in fluid connection with pipeline 430 via flexible tubing 431. The flexible tubing 431 is preferably stress relieved by a secure attached to suspending cable 112. By water pistol we mean to include any type of spray or squirt nozzle a player can aim at another player, spectator or target either by hand or otherwise. Accordingly, the water gun need not resemble an actual weapon, but can be any form of a squirt or spray orifice mounted to a wand, flexible hose wand or attached or integrated with the seat. A hand held water pistol 415 is preferably tethered to seat 110 on an optionally retractable leash or a supporting strap or mount that stress relieves tubing connection and/or tether when the player does not hold the pistol.

Alternatively, the water pistol can be of the conventional type, drawing water from a closed reservoir, such as that disclosed in U.S. Pat. No. 5,603,361, which is incorporated herein by reference. Accordingly, the seat 110 may include provisions for storing water, or mounting a detachable reservoir, squirt gun or pistol. For example, the water pistol may be in the form of spray nozzles 425 mounted on the seat. The spray nozzles in this case would be controlled manually by release lever 428. Fixing the spray nozzle to the seat could increase the difficultly in hitting the adjacent player, as exposure to the water spray or stream is limited to the portion of the oscillatory motion that depends on the players relative speed.

Release lever 428 optionally opens and rotates to direct a higher velocity water jet through tube 426 having a larger diameter opening than the orifice of spray nozzle 425 or 425'. Thus, release lever 428 enables the player to release a high volume of water as a jet to modify or modulate the swing velocity. Specifically, by rotating tube 426 using the handle or release lever 428 the jet can be directed opposite the direction of the swings current movement to increase the speed and height, or into the direction of motion to slow the swing.

Alternative targets include those that accumulate water sprayed or squirted directly therein, and optionally include a weight or balance responsive actuator that dumps, sprays, streams or otherwise releases the accumulated water in target container onto the player in the seat. In addition to providing fixed spray nozzle 425 for shooting another player or spectator, or demountable spray gun for aiming at a target, additional spray nozzles are also optionally mounted above seat of opposing player for control by a player in another seat, independent of the target use or location. For example, in FIG. 4 an optional target 420 is disposed above the player sitting in seat 110. Target 420 can be used in conjunction with other accessories for either wet recreation or scored game play. For wet play, spray nozzles 425' is connected to the water source via a valve actuated by impact or other actuation of target 420, which can include the force from water sprayed onto target 420 by another player.

Many of the play activities enabled by various features and embodiments of the instant invention are interactive and require at least adjacent players to see each other during at least a portion of the swings oscillatory motion. Thus, FIG. 5 illustrates yet another embodiment wherein the players can alternative orientation with respect to the plane of the oscillatory motion depending on the play activity. More specifically, as shown for play system 500 in FIG. 5C, it is desirable to configure adjacent seats 511 and 512 so that players are transverse to the direction of swing oscillation and facing each other, in contrast to seat 510, in which the player faces forward, in the direction of swing oscillation. Accordingly, players in swings 511 and 512 can more readily engage in interactive play that involves targeting the other player, for example using the squirt gun or targets illustrated in FIG. 3 or 4.

Figure 5A:
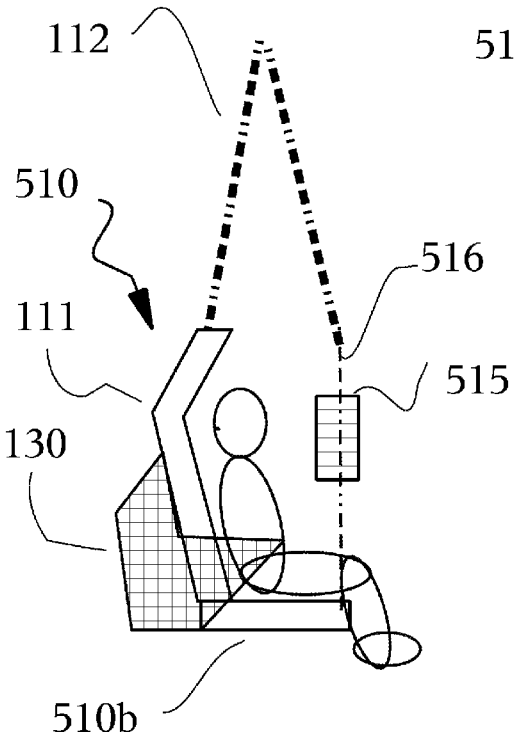
FIGS. 5A and 5B are orthogonal elevations of a swing seat embodying alternative features of the present invention that enable relative rotation of the swing seat for interactive play.
Figure 5B:
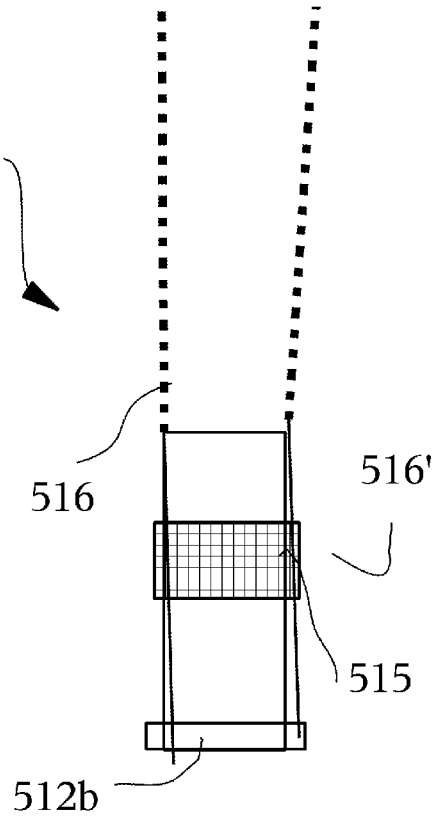

Another embodiment, shown in FIGS. 5A and 5B provides for the conversion of swing seats from the configuration of seat 501 to 503 by rotation during interactive play. FIG. 5A corresponds to section A-A' through seat 510 of FIG. 5C, whereas FIG. 5B is the corresponding orthogonal elevation. As the swing seats in FIGS. 5A and 5B may also include targets of the types previously described or illustrated, the player's ability to rotate the seat during oscillation creates a further play challenge wherein players may perturb the target position by rotating the seat as the player releases a projectile, water, or activates a light or laser gun.

FIGS. 5A and 5B are intended to illustrate another alternative embodiment for mounting a safety harness 515 to the swing seat 510. Harness 515 is secured to support cable 516 and 516' but is at least releasable to translate along the support cable length so that players lift the harness up for egress and entry, as shown in FIG. 5B, lowering it toward the seat bottom 510*b* after the player enters seat 510.

It should be recognized that principle of harness movement or engagement to protect the player is equally applicable to the other games and activities that might require the player's movement or removal of at least one hand that would otherwise be used to grasp the seat or a related supporting structure.

It should also be appreciated that in any of the aforementioned embodiments, the description of a seat or seat bottom for sitting is intended to encompass alternative shapes and structure that permit or encourage safe play while standing, lying in a prone position, and the like.

It should be further appreciated that the embodiments encompassing a rotating seat do not preclude combinations with targets previously described, particularly those that are operatively coupled to a water source or water source actuator, as well as the propulsion water source, nozzles or squirt gun. The water source or point of release can be connected to any of the structure above the rotary coupling 545. Alternatively, a continuous water source can be disposed co-axial with the rotary couplings axis of rotation, using a rotary fluid fitting. Alternatively, the rotary coupling can be suitably limiting in the range of rotary motion such that a flexible conduit or pipe that traverses between the fixed platform 545 and rotary platform 540 would not be tangled or severed from repeated rotation in the same direction. Accordingly, the optional positions for the terminus or outlets of a water source include the seat back 511, seat bottom, 510*b*, suspending cables 516 and safety harness 515. Preferably, the water actuator or targeting control is disposed on a common component or actuator with release lever 514, for example, a component that emulates an aviator's joystick, a steering wheel, and arm support console, and the like.

It should be appreciated that alternative embodiments for competitive game play include utilizing a target that rotates, or otherwise move, at the players control or independent of seat rotation controlled by player. For example, the seat might remain fixed, while the only the target is cable of independent rotation or other movement apart from the oscillatory motion of the swing seat.

In yet other embodiments, target activation, by an opposing player, optionally engages seat rotation, for example by delatching the stop or release mechanism associated with rotary coupling 525.

Alternative embodiments of the invention utilize lights, sound or other types of information displays that are responsive to the motion of the swings themselves, thus suitable for interactive play by younger players, or educational games as will be further described below. Accordingly, FIG. 6 illustrates the operative principles of a sensing device 600 for determining at least one of the height, frequency or speed of the swing during oscillation. The purpose of the sensing device is to record the time at which the swing seat reaches the maximum of height during the oscillatory motion and record the height. It should be appreciated motion and position-sensing devices are known in the art field of factory automation, robotics and material handling, therefore FIG. 6 should be understood to be merely illustrative of the operational requirements of such device as they relate to providing the inventive functions described herein.

Figure 6A:
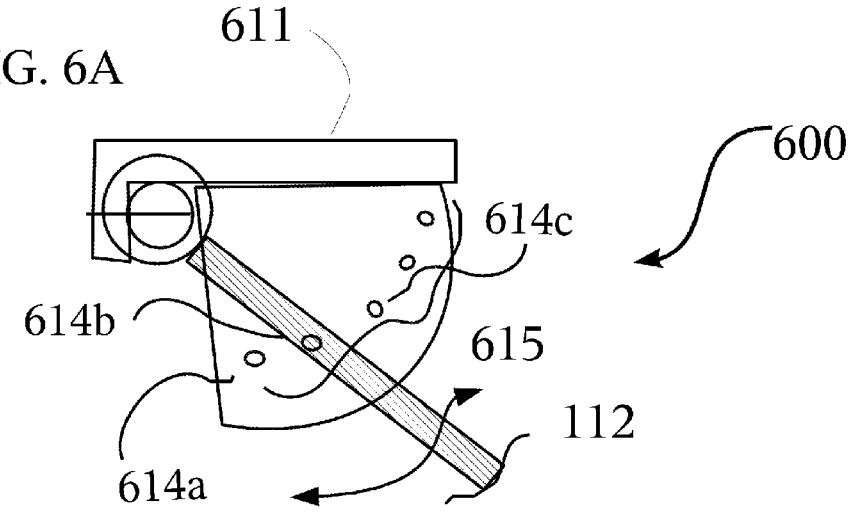
FIGS. 6A and B illustrate the operative principles of swing motion, range and timing measuring devices.
Figure 6B:
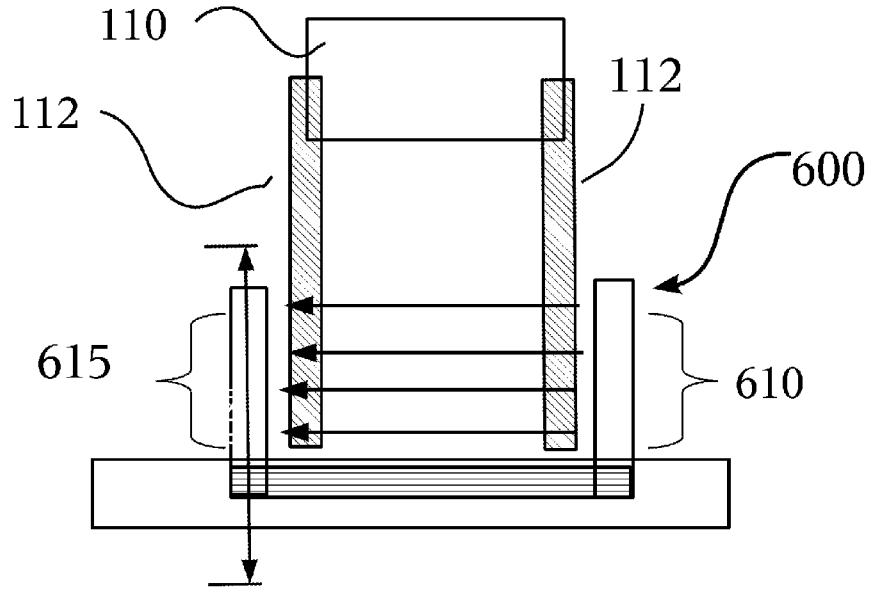

As illustrated by the plan view in FIG. 6B sensing device 600 is preferably mounted in association with horizontal member 195 and disposed adjacent to suspending cables 112 associated with each seat. Sensing device 600 includes one or more light emitting devices 610 and associated photodetectors 615 spaced apart there from such that a free space optical path, indicated by straight arrays from emitters 610 to associated detectors 615, will be interrupted by the oscillatory motion of the swings seat suspending cable 112. FIG. 6A is an elevation of detector 600 taken through section A-A' in FIG. 6B to illustrate the array of photodetectors 614 as viewed from the light emitter director with intervening swing suspension cable 112. Sensing device 600 preferably includes an array of photodetectors 614 co-mounted on a plate or support 615 to span the potential range of motion of suspending cable 112. Plate 615 is disposed on a support bracket 611 such that it extends out from horizontal member 195 to encompass the free range of motion of suspending cable 112. Accordingly, one or more light emitting devices 610 provides a beam that extends to include the detector array 614 such that the time sequence of adjacent photodetectors in group 614 receiving a null signal, caused by the blocking of the light beam from emitter 610, will indicate the passage of the suspension cable as the swing oscillates. The position of the suspending cable 112 at the greatest height of the swing oscillation corresponds to a position between the last photodetector in array 614 to be interrupted (which in this figure is detector 614*b*) and the first photodetector not to be interrupted (614*c*) during a repeating sequence of interruptions. Specifically, detectors 614*a* to 614*e* null signals will be detected in the temporal sequence a-b-a. The detector array 614 is optionally symmetrically disposed about horizontal member 195 to cover the full range of oscillatory motion; however, for most purposes the non-symmetric array illustrated will be sufficient, as the momentum or height change between is not expected to be significant during a single oscillation cycle. Accordingly, by providing a timing and logic circuit responsive to the variations of photo detector signals, and using a geometric correction to account for the total length of suspending cable 112, the maximum height of the swing is readily determined by a microprocessor for communication to players and/or spectators by various methods, as will be further described. Further, the same logic circuit can be configured to determine the elapsed time between each instance of reaching the maximum height during the swing oscillation, for determination of the instantaneous or maximum swing velocity, as well as to count the number of oscillation cycles.

Thus, the several parameters that reflect movement of the swing can be communicated to the players as well as observers by additional electronic methods and output devices, including lights and visuals displays that provide an analog output, digital displays or auditory output using loudspeakers, which are further described with reference to FIGS. 7A, B and C.

FIG. 7A is a front elevation view of swing system 700 having a variety of optional lighting devices, power sources and control systems associated with the supporting structure or the swing seats. For example, light emitting devices 715 can be an array on a flexible cable that extends along swing seat suspending members. Alternatively, fiber optic lights can be deployed in the same manner, for example with lighting cable or fiber bundle 710 wrapped around horizontal and vertical support members. Light emitting devices 716 are optionally integrated into the swing seat structure 710, as well as external or detachable device 718. As shown in FIGS. 7A and 7B lights or light array 716 can be associated with one or more of the front, back, or side of seat 710. Thus, light emitting device 716 as mounted on the side of seat 710 in FIG. 7B, will indicate the range of the seat oscillation to an external observer at night. As swing system 700 comprises a large number of linear elements, such as the horizontal or vertical support frames and suspending cable, a preferred light emitting device is a fiber optic cable designed for continuous side emission. As the fiber optic lighting fixture is end coupled to a light source, the light source is not generally limited by the considerations of having an electrical power supply near wet play areas.

As previously mentioned light sources include Laser or focused lights for aiming at targets, such as for laser tag type play. Accordingly, such hand held devices are preferred attached to the seats by a retractable tether, as described for the water pistol. Alternatively, either Laser or focused lights 719 on seat 710*b* can be fixed to the side or bottom of a seat to illuminate the ground alternatively display the range of seat movement during oscillation.

Alternative lighting devices include incandescent sources, fluorescent sources, black lights, as well as light emitting diodes, electro-luminescent lights and the like.

Light power sources optionally include solar cells 706, shown in a preferred location mounted on horizontal swing support member 195, it being understood that the energy generated by photovoltaic solar cell recharges a battery that can operate any alternative electronic device disclosed herein.

Alternative light, speaker or motor power sources include low voltage via transformer 705 connected to power mains, as well as battery, regular line voltage, but can also include power generated by a piezoelectric transducer coupled to the oscillating motion of the swing.

The form of light output may include changes in selection, power or pattern of lights triggered for challenging players by indicating a maximum height or velocity, as well as absolute position during the swing. Analog displays include any method of triggering or varying the spatial or temporal output of lighting fixtures that might be arranged on the fixed or moving structures of the swing, such as device 715 and 716. For example, a light pattern might be purely temporal, that is a one or more flashing lights, or a time sequenced illumination of a series of adjacent lights, i.e. to display a moving bar or object.

Digital output might include a numeric display, for example a score display board 755, which is shown in one of many alternative locations being mounted on suspending cable 112. However, a digital output might also include icons having a size, color or shape to represent a number, a relative quantity or a progressive change.

Further, the output of the logic circuit, associated with device 600 in FIG. 6, might include control of safety lights that point to positions on the ground thus warning spectators to avoid colliding with the moving swing by staying outside a marked area. Alternatively, the logic circuit output might simply trigger general light or output speaker to signify that the swings are being used, thus alerting adults whose attention and supervision of smaller children might be required.

Various forms of auditory output device may be used with or substitute for at least some of the entertainment and safety functions of visual lighting. For example, the auditory output may include changes in volume, pitch or continuity to reflect the player's maximum height or velocity, as well as absolute position during the swing. For example, as logic circuitry can also maintain a record of the previous height reached, with the pitch, volume or continuity of the signal changing as the swing position approaches this height. If the play reaches a higher level than the previous cycle one or more additional indicators might be provide a distinct output to distinguish between decay of oscillation. FIG. 7C illustrates one embodiment for locating such lighting output control devices, speakers or control circuits associated therewith. Thus, output speaker 718 is mounted below the seat. Further, the various lighting fixtures and features described above can optionally operate manually, by the player from a seat-mounted console 717, or by a spectator at a distance, such as to provide sufficient light that encourages or extends the hours available for safe play.

Alternatively, the output might include a synthesized or recorded voice announcing a numeric score or outcome, or to change players after fixed number of cycles, time of use, or a competitive criteria. Further, the synthesizer-recorded voice might be combined with a digital or pictorial display that reinforces counting of numbers, the alphabet, addition or subtraction or other elementary school activities.

Further, the auditory output need not be an electronic speaker, but may alternatively comprise a whistle or other device that produces a sound in response to the high air velocity with respect the moving seat. Accordingly, the sound generating device may be incorporated into the seat or any other moving fixtures associated, such as a whistle or speaker output 718 mounted below the seat. A whistle preferably includes a horn or cone shaped entrance orifice to collect and increase the velocity of air in front of the swings path without creating turbulent flow, which might adversely affect the output. Accordingly, such manual devices may function as musical instruments, and also include baffles, holes or other sound or pitch modulating mechanisms that controlled by the seated player. Sound generating device such as air whistle or related wind instrument are optionally responsive to movement and velocity of the swing seat such that pitch and/or volume changes with speed.

FIG. 8 illustrates another embodiment of the invention in which a soap bubble generator 800 is coupled to at least a portion of the swing seat 110 to produce bubbles during swing movement. In a preferred embodiment, the bubble generator provide a visual indicator of the range of seat swing motion as it releases bubbles along the path of the swing to form a constantly dissipating curtain that visible to both players and observers. The curtain boundaries provide an indication of the range of the player swing during the previous cycles of oscillation.

Figure 8B:
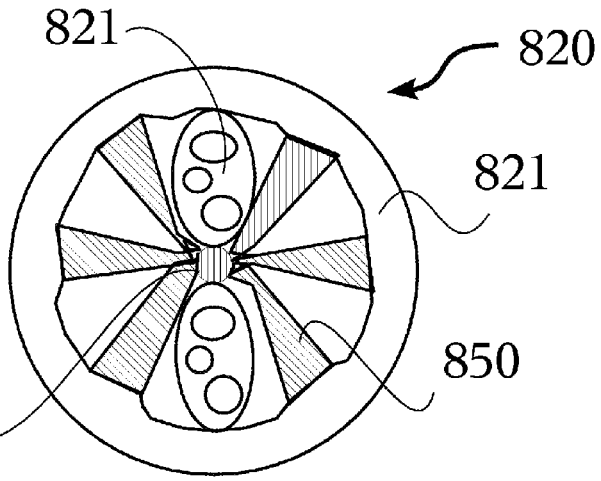
FIG. 8B illustrates in further detail a subcomponent of the soap bubble generator of FIG. 8A via an orthogonal section to reveal further detail.
Figure 8A:
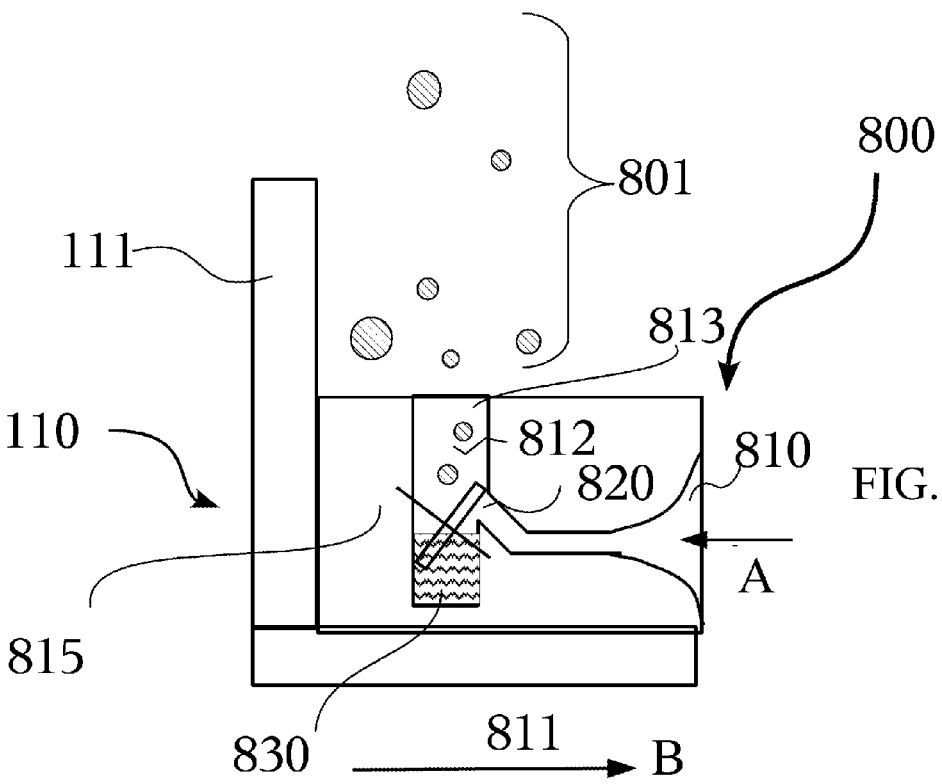
FIG. 8A is a cross-sectional elevation of one embodiment of a soap bubble generator disposed on play swing seat.

The bubble generator 800 represents an embodiment that operates in response to swinging motion of seat 110 to produce a continuous stream of bubbles 801. As shown in the cross sectional elevation through generator 800 in FIG. 8A, incoming air moves in the relative direction of arrow A with respect to the seat, while the seat moves in the direction of arrow B with respect to the ground. A funnel or cone shape orifice 810 at the forward side of generator 800 collects air in front of the swing seat path to provide a higher velocity air stream as the cone narrows to channel 811. The higher velocity air in channel 811 is directed to a bubble-generating chamber 812. Bubble generating chamber 812 has an outlet orifice 813 and a bubble-generating frame 820 disposed between the air inlet channel 811 and the outlet orifice 813. The bubble generating frame 815 can be either stationary, responsive to the oscillatory motion of the swing, or under the control of the player, provided it continuously encounters a sufficient quantity of soap bubble solution. In this embodiment, soap solution is provided by reservoir 830 disposed at the bottom of chamber 812. FIG. 8B is a detail elevation showing the front of bubble generating frame 820. The frame 820 is a disc comprising at least two panels 821 and 822 disposed on opposing sides of a central spindle 816 for rotation about axis 815 in FIG. 8A. Each of frame panels 821 and 822 is submerged in the soap solution reservoir 830 during each rotation cycle about the rotary axis 815, such that they are subsequently exposed to the air stream entering chamber 812 from channel 811. As a soap film will become suspended across frame panels 821 and 822 upon their removal and draining of excess solution (back into reservoir 830), the air jet emerging from channel 811 will deforms the suspending soap film causing the formation of a plurality of soap bubbles, which then exit with the air jet, through the outlet orifice 813. Frame 820 in FIG. 8B also includes propeller blades 850 disposed between frames panels 821 and 822 such that the incoming air urges a continuous rotary motion about axis 815 creating a relatively continuous stream of bubbles. The reservoir 830 is manually filled or optionally constantly replenished by gravity or pump fed source. It will be recognized that two or more generators can be combined to produces bubbles as the seat oscillates in both direction, or a second cone can be provided in the opposite direction that connects to channel 811 or another opening into chamber 812.

Thus, the bubble generator 800 provides entertaining and challenging play activity for younger children, as the quantity, type or size of bubbles is optionally responsive to the swing velocity or alternative controls available to the player.

The soap bubble generator can alternatively be independent of swing movement; for example, it might include a manual lock of moving components, like frame 820, to conserve soap solution, as well as other controls to vary the quantity and quality of bubbles for competitive play as well as entertainment. Further, the soap bubble generator is optionally powered by a motor to control either a fan, for blowing air against a soap film-forming frame, moving the frame to replenish the bubble film, or operating a pump to supply soap solution to the frame directly, or fills generator from a remote reservoir. Alternatively, a pump may be deployed to force soap solution through an orifice in combination with an air stream to generate soap bubbles. Power for a non-swing operated bubble generator includes hand power or any electric power source previously taught for lighting purposes.

It will be recognized that the bubble generating device can be an accessory for attachment to various parts of the seat, or integrated with the seat structure, that is below the seat or in a side console.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

We claim:

1. A playground apparatus, comprising in combination:
a. a support structure
b. at least one seat suspended above a surface from said support structure for reciprocating transport of a user,
c. a game target disposed for interactive play by a seated user, a portion of said game target being mountable on a surface beneath the seated player,
d. a harness coupled to at least one of said seat and said support structure and restraining the user or users for movement while interacting with said game target, wherein the game target is adjustable from 90 to 180 degree configuration below the user, including but not limited to, the maximum distance of oscillation of the player from one direction to another.

2. A playground apparatus according to claim 1 wherein the horizontal target can capture objects projected from the user during oscillation.

3. A playground apparatus according to claim 2 wherein the target is a large polygonal shape extending in every direction beneath the user whether the user is stationary or in oscillation.

4. A playground apparatus according to claim 1 wherein the target is a photo-detector for receiving a beam of light.

5. A playground apparatus according to claim 1 wherein the target is a photo-detector for receiving a beam of light.

6. A playground apparatus, comprising in combination:
a) a support structure,
b) at least one seat suspended above the ground surface from said support structure for reciprocating transport of a player,
c) a game target disposed for interactive play by a seated player,
d) said game target being mountable on the ground surface; and,
e) a harness coupled to at least one of said seat and said support structure and surrounding the player for restraining the players movement while interacting with said game target,
f) wherein the game target receives an object thrown or projected by the seated player.

7. A playground apparatus according to claim 6 wherein the game target captures the object.

8. A playground apparatus according to claim 6 wherein the object is water.

9. A playground apparatus according to claim 6 wherein the target is a photo-detector for receiving a beam of light.

10. A playground apparatus, comprising in combination:
a) a support structure,
b) at least one seat suspended above the ground surface from said support structure for reciprocating transport of a player,
c) a game target disposed for interactive play by a seated player,
d) said game target being mountable on the ground surface; and,
e) a harness coupled to at least one of said seat and said support structure and surrounding the player for restraining the players movement while interacting with said game target,
f) wherein the game target receives an object thrown or projected by the seated player and the game target is mountable on said support structure.

11. A playground apparatus, comprising in combination:
a) a support structure,
b) at least one seat suspended above the ground surface from said support structure for reciprocating transport of a player,
c) a game target disposed for interactive play by a seated player,
d) said game target being mountable on the ground surface; and,
e) a harness coupled to at least one of said seat and said support structure and surrounding the player for restraining the players movement while interacting with said game target,
f) wherein the game target receives an object thrown or projected by the seated player and the game target is mountable on said seat.

* * * * *